US006581235B1

(12) United States Patent
Stocco

(10) Patent No.: US 6,581,235 B1
(45) Date of Patent: Jun. 24, 2003

(54) APPARATUS FOR CLEANING AND REMOVING DEPOSITS FROM INTERNAL WALLS OF DUCTS FOR CONVEYING FLUIDS OF ANY KIND

(75) Inventor: Ezio Stocco, Castello di Godego (IT)

(73) Assignee: International Westar Limited, Valletta (MT)

( * ) Notice: Subject to any disclaimer, the term of this patent is extended or adjusted under 35 U.S.C. 154(b) by 0 days.

(21) Appl. No.: 09/523,961

(22) Filed: Mar. 13, 2000

(30) Foreign Application Priority Data

Mar. 19, 1999 (IT) ..... BO99A0130

(51) Int. Cl.[7] ..... B08B 9/04
(52) U.S. Cl. ..... 15/104.061
(58) Field of Search ..... 15/104.061, 3.5

(56) References Cited

U.S. PATENT DOCUMENTS 2,201,680 A 5/1940 Haynes
4,538,316 A 9/1985 Reinhart
5,617,604 A * 4/1997 Erich
5,903,946 A * 5/1999 Collins

FOREIGN PATENT DOCUMENTS

DE 117 277 C 2/1901
DE 29 44 709 A 5/1981
DE 41 11 452 A 10/1992

* cited by examiner

*Primary Examiner*—Randall E. Chin
(74) *Attorney, Agent, or Firm*—Daniel O'Byrne

(57) ABSTRACT

An apparatus for cleaning and removing deposits from internal walls of ducts for conveying fluids of any kind, comprising at least a propulsion head which is constituted by an elongated stem and by an impeller which is mounted freely on the stem and is suitable to produce an uninterrupted vibration and a series of hydraulic shocks or hammerings in order to cause the advancement of the head in the duct and a cleaning and/or removal element which is provided with means for rigid fixing to the front end of the stem or with means for engagement to the front or rear of the stem.

5 Claims, 13 Drawing Sheets

APPARATUS FOR CLEANING AND REMOVING DEPOSITS FROM INTERNAL WALLS OF DUCTS FOR CONVEYING FLUIDS OF ANY KIND

BACKGROUND OF THE INVENTION

The present invention relates to an apparatus for cleaning and removing deposits from internal walls of ducts for conveying fluids of any kind, such as crude oil or process products, water or the like.

The apparatus according to the present invention can also be used effectively to clean gas pipes of any kind, for drains or in any case for any duct having a preferably circular cross-section.

It is known that piping is subject to become partially clogged by deposits, sediments or scale which can reduce its capacity even considerably.

Currently commercially available devices meant to clean and remove deposits from piping are usually constituted by cleaning heads, which are either pushed along the pipe by the pressure of the fluid or pulled by a drawing cable; some of said heads are meant to push in front of them the removed sediments or deposits.

These apparatuses have considerable limitations, because they are unable to work effectively on deposits of a certain consistency, since the pressure of the fluid is not sufficient to remove tough deposits or displace large sediments or deposits.

Another problem that affects conventional devices is that they are unable to pass through narrow elbows, joints, tapering sections or the like; moreover, if the apparatus jams inside the pipe, said pipe is completely obstructed.

SUMMARY OF THE INVENTION

The aim of the present invention is to eliminate the above-noted drawbacks, i.e., to provide an apparatus for cleaning and removing deposits from the internal walls of ducts for conveying fluids of any kind which is capable of working even on very tough and large deposits, regardless of the length and diameter of the pipes and even in the presence of elbows, joints or changes of direction even if they have a tight curvature radius.

Within the scope of this aim, an object of the present invention is to provide an apparatus which is simple, relatively easy to provide in practice, safe in use, effective in operation and has a relatively low cost.

This aim, this object and others which will become apparent hereinafter are achieved by the present apparatus for cleaning and removing deposits from internal walls of ducts for conveying fluids of any kind, characterized in that it comprises at least a propulsion head which is constituted by an elongated stem and by an impeller which is mounted freely on the stem and is suitable to produce an uninterrupted vibration and a series of hydraulic shocks or hammerings in order to cause the advancement of the head in the duct and a cleaning and/or removal element which is provided with means for rigid fixing to a front end of the stem or with means for engagement to the front or rear of said stem.

BRIEF DESCRIPTION OF THE DRAWINGS

Further characteristics and advantages of the present invention will become apparent from the following detailed description of a preferred but not exclusive embodiment of an apparatus for cleaning and removing deposits from internal walls of ducts for conveying fluids of any kind according to the invention, illustrated only by way of non-limitative example in the accompanying drawings, wherein.

DESCRIPTION OF THE PREFERRED EMBODIMENTS

Figure 1:
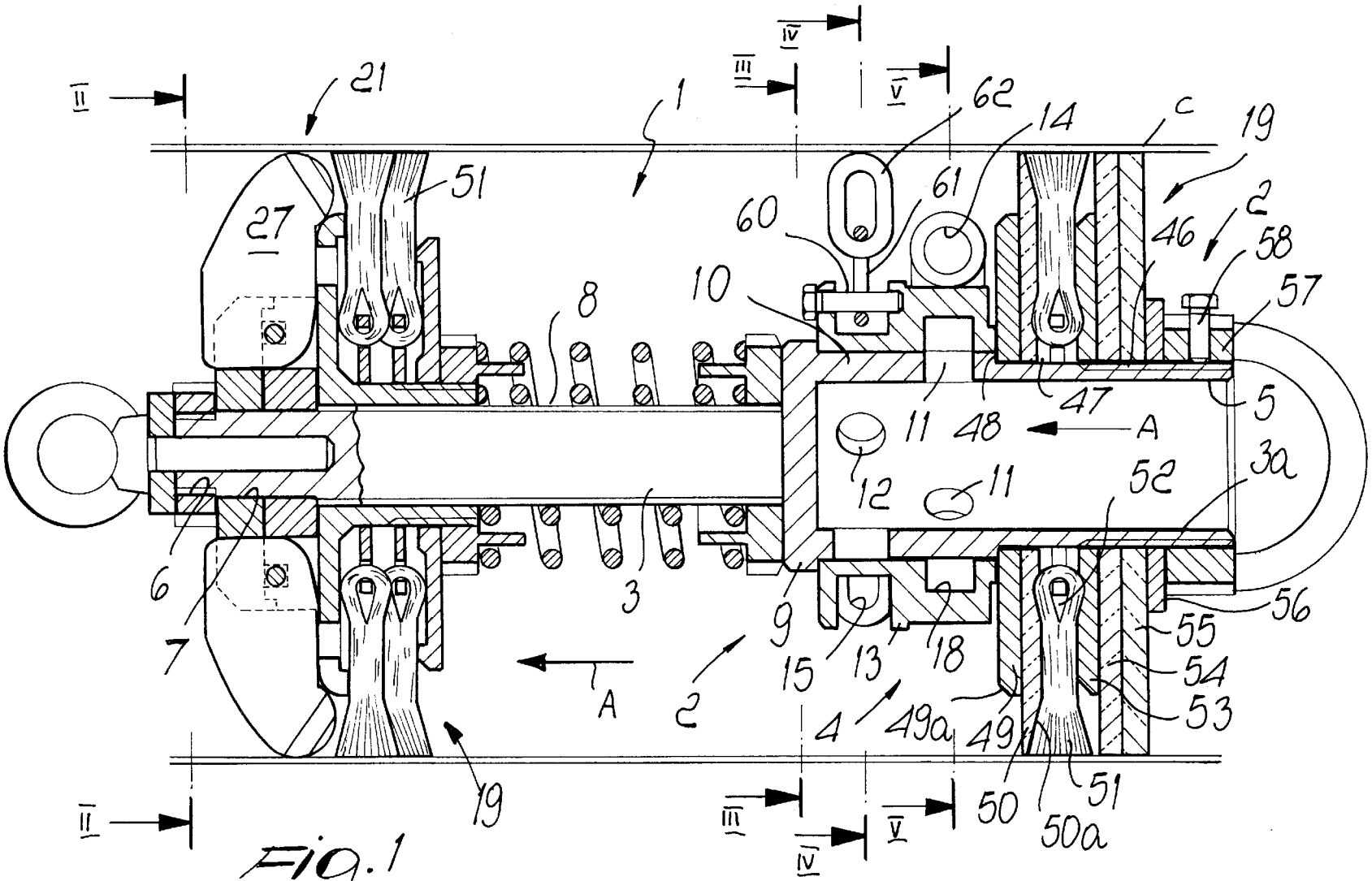
FIG. 1 is a sectional side view, taken along a diametrical plane, of an apparatus according to the invention on a single central monolithic stem.
Figure 3:
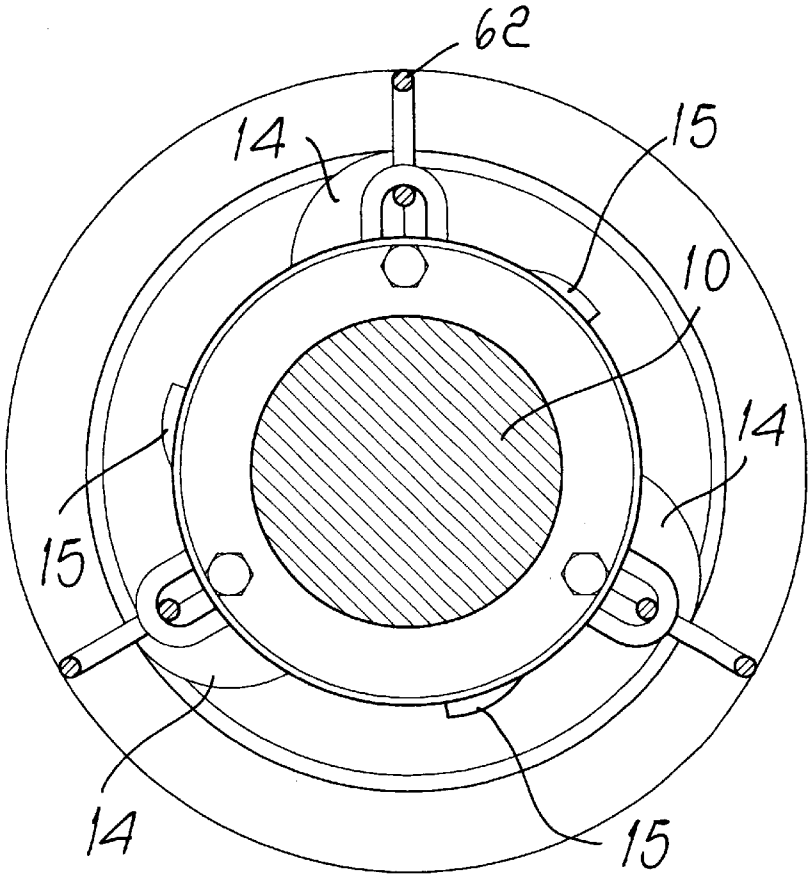
FIG. 3 is a sectional view, taken along the plane III—III of FIG. 1.
Figure 2:
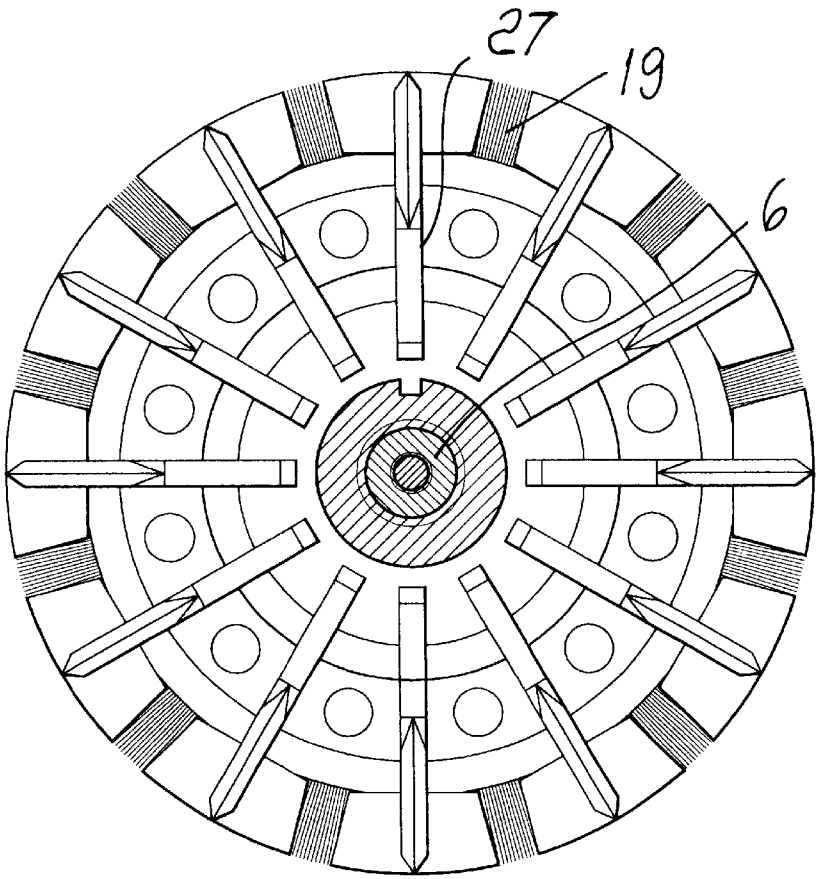
FIG. 2 is a sectional view, taken along the plane II—II of FIG. 1.
Figure 5:
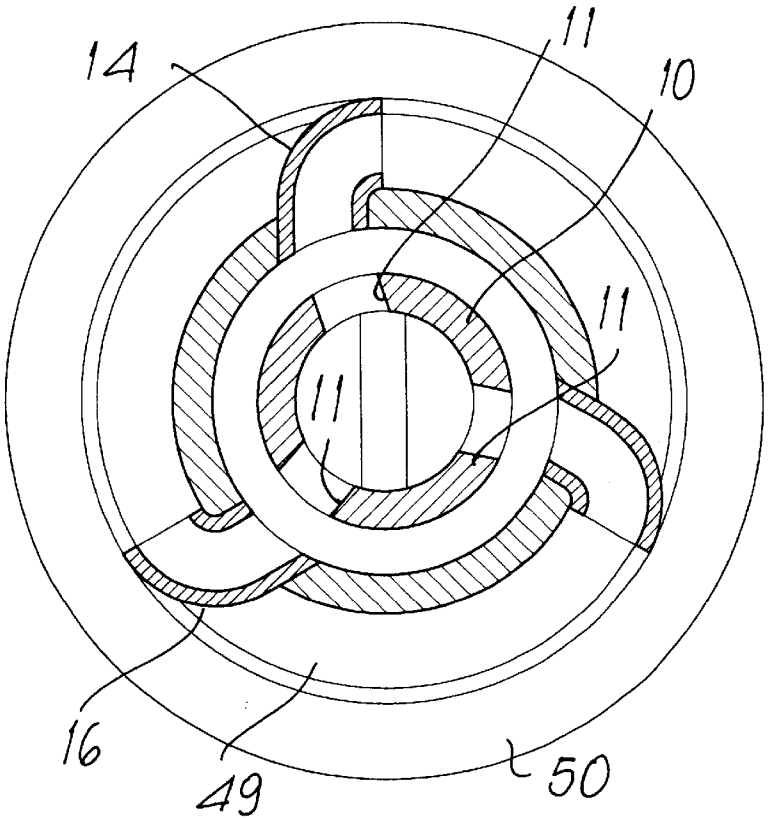
FIG. 5 is a sectional view, taken along the plane V—V of FIG. 1.
Figure 4:
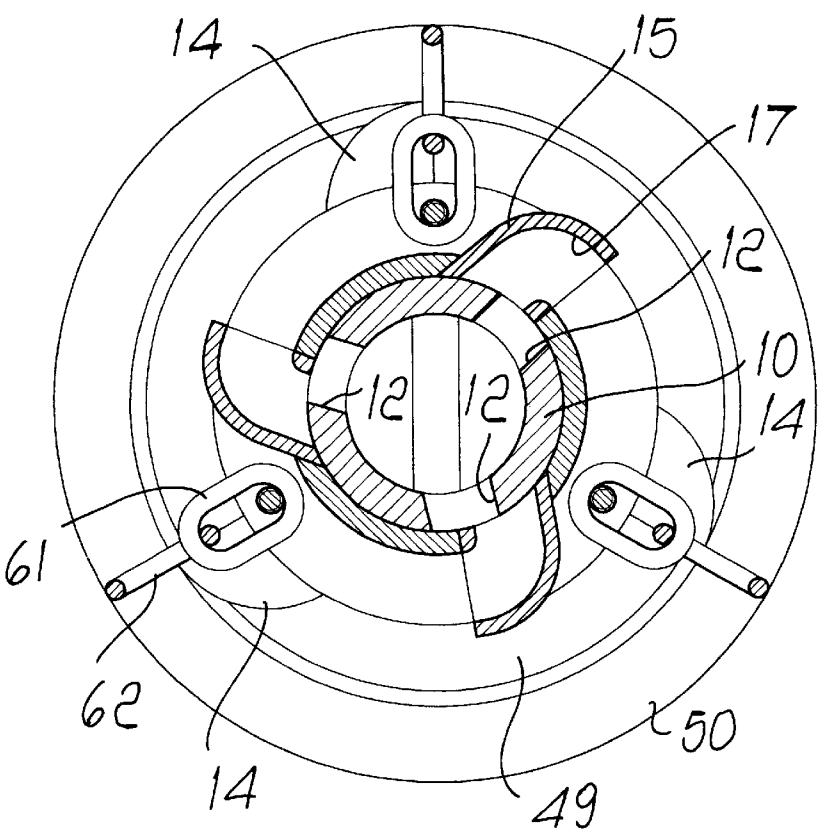
FIG. 4 is a sectional view, taken along the plane IV—IV of FIG. 1.
Figure 6A:
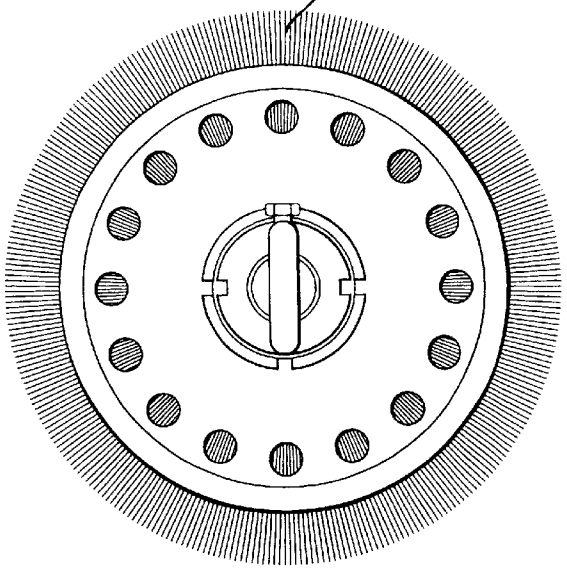
FIGS. 6 and 6*a* are respectively a side view and a front view of a single-stage apparatus according to the invention with elements for cleaning and centering in the duct which are provided with brushes and ate arranged at the front.
Figure 6:
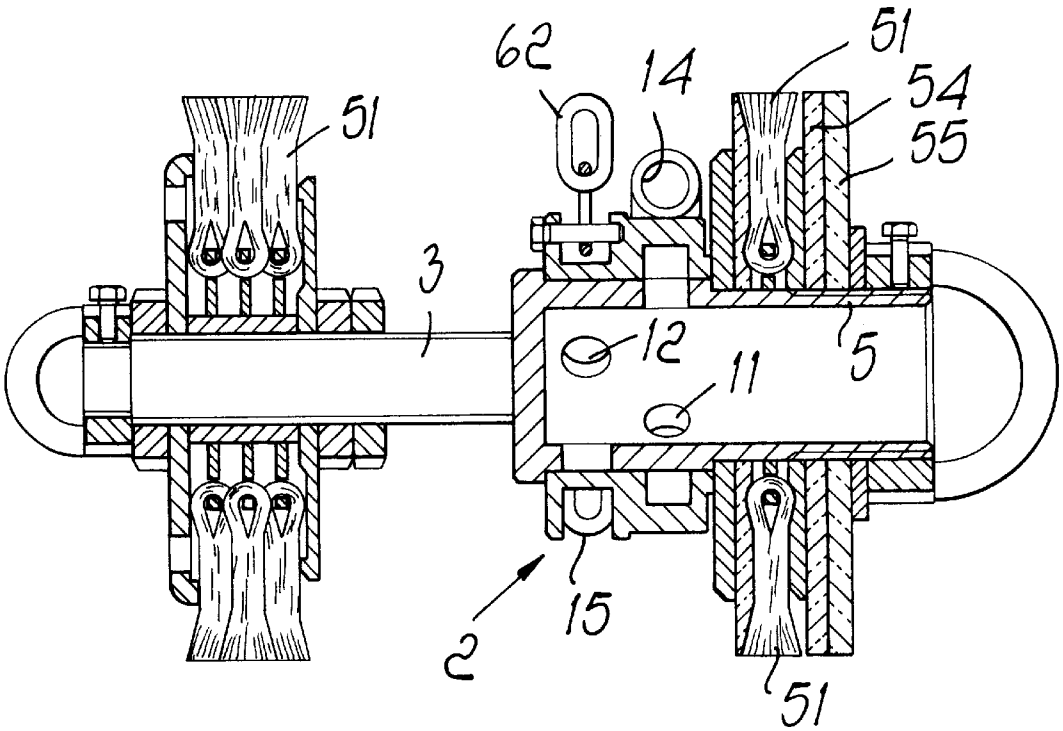
Figures 7, 7A:
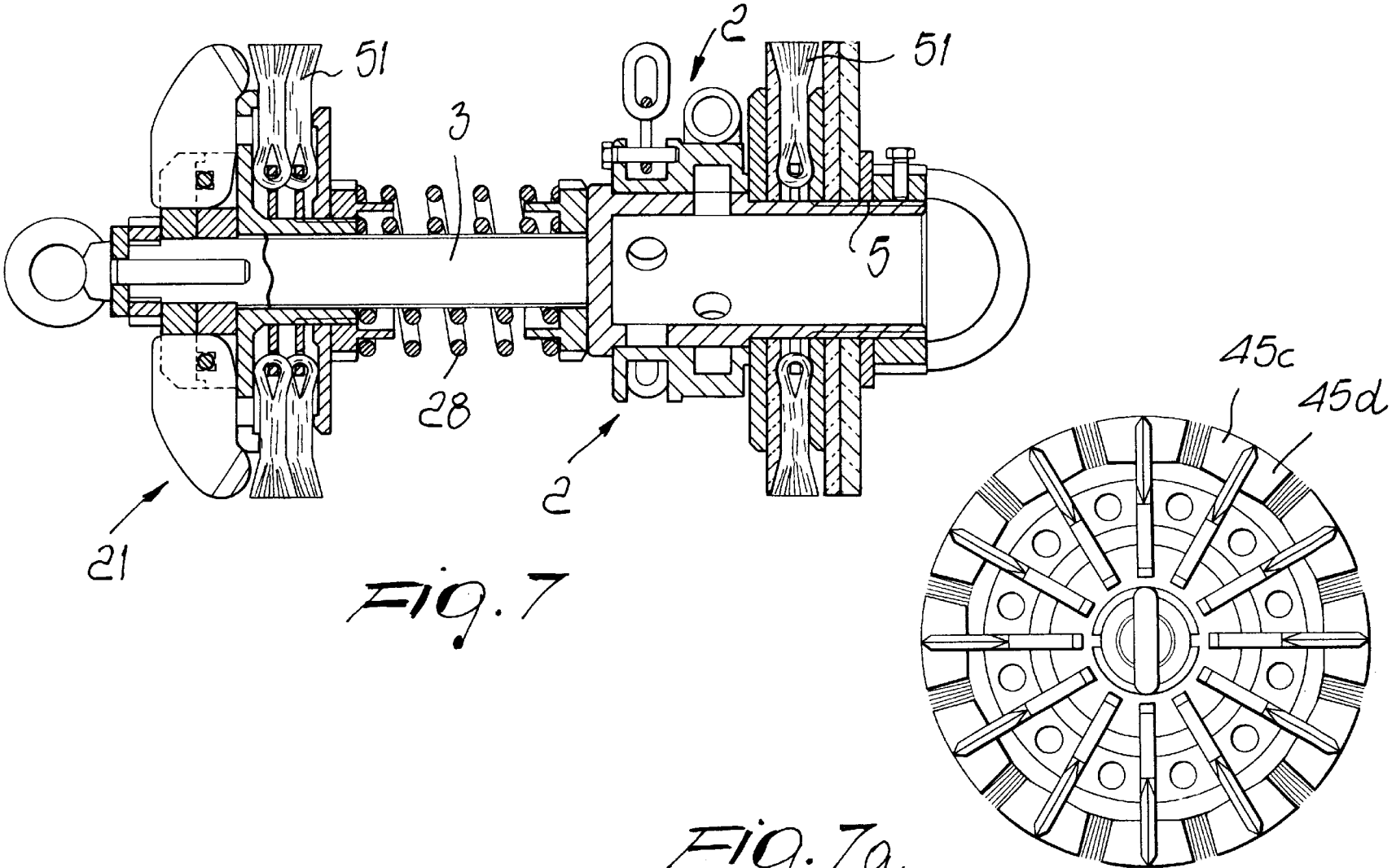
FIGS. 7 and 7*a* are respectively a side view and a front view of a single-stage apparatus according to the invention with elements for cleaning and centering in the duct which are provided with brushes and with a scraping head and are arranged at the front.
Figure 8A:
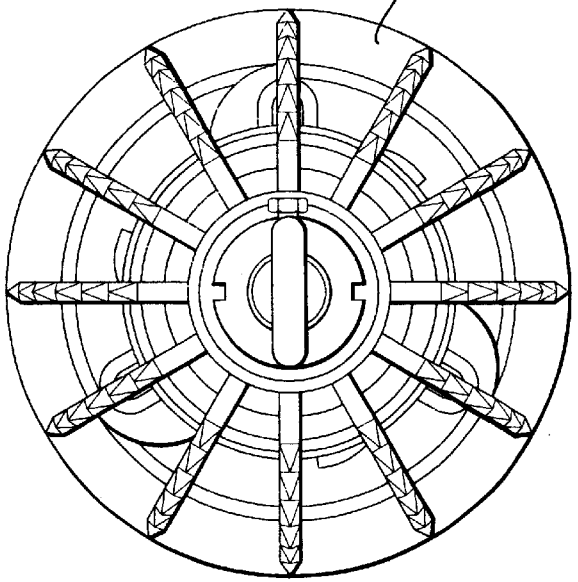
FIGS. 8 and 8*a* are respectively a side view and a front view of a single-stage apparatus according to the invention with elements for cleaning and centering in the duct which are provided with brushes and with a breaker head and are arranged at the front.
Figure 8:
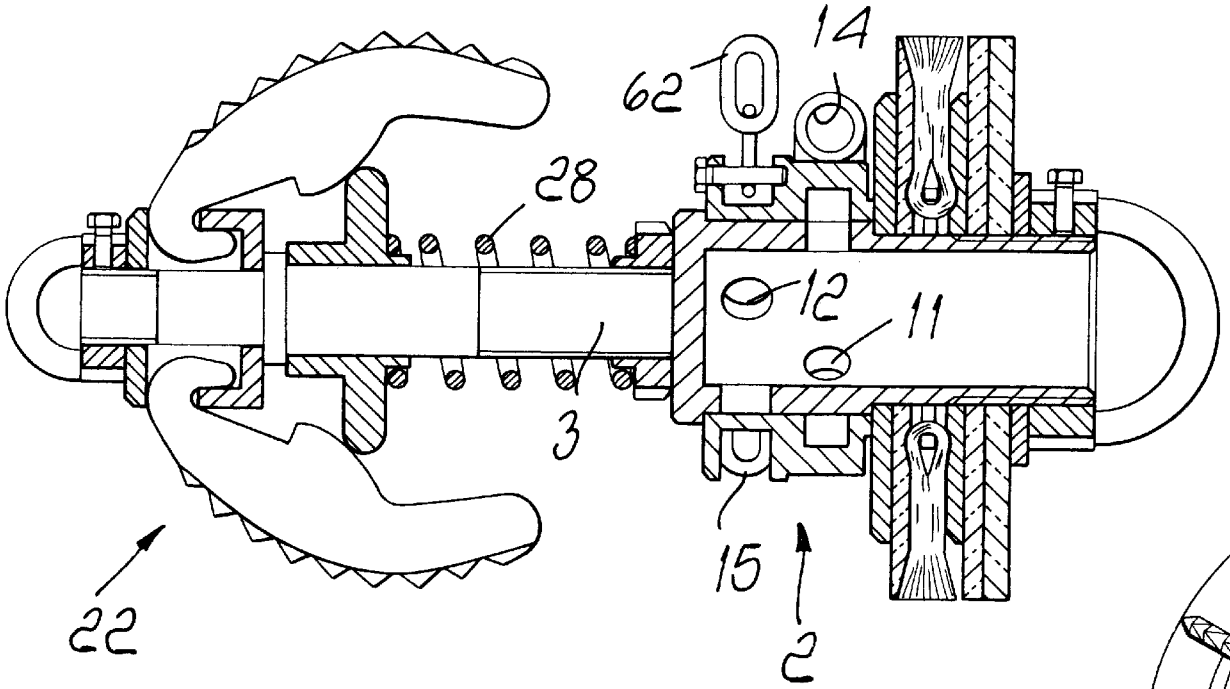

With particular reference to the above figures, the reference numeral 1 generally designates an apparatus for cleaning and removing deposits from internal walls of ducts C for conveying fluids of any kind which flow in the direction of the arrow A, according to the invention.

The apparatus 1 comprises at least a propulsion head 2 which is constituted by an elongated stem 3 and by an impeller 4 which is mounted freely on the stem and is suitable to produce a series of hydraulic shocks or hammerings for the advancement of the head in the duct and a cleaning and/or removal element which is provided with means for rigid fixing to the front end of the stem or with means for engagement at the front or rear of said stem.

In the rear region, the stem 3 has a larger-diameter portion 3*a* which is crossed by an axial cavity 5 which is open to the rear for the intake of the fluid under pressure.

The stem 3, starting from its front end, has a first externally threaded portion 6, a second smooth portion 7, and a third externally threaded portion 8; the portions 6, 7 and 8 have gradually larger diameters.

The portion 3*a* has, at the front, an annular flange 9, an externally smooth intermediate region 10.

In the front region of the portion 3*a*, at the intermediate region 10, in the wall of the stem there are two mutually staggered series of radial holes 11 and 12, particularly for example three holes 11 and three holes 12, for discharge of the fluid.

The impeller 4 is fitted so that it can rotate freely on the region 10 of the stem and comprises a bush 13 which is crossed centrally by a hole whose diameter is substantially equal to the diameter of the region 10 and has two sets of nozzles 14 and 15, particularly for example three nozzles in each set, for the discharge of the fluid; the nozzles are inserted in corresponding holes 11 and 12, are constituted by curved tubular segments 16 and 17 and end with portions which have the same tangential orientation and are capable of turning the impeller 4 by reaction to the discharge of the fluid.

The first set of nozzles 14 is fed continuously by means of an annular channel 18 which is formed on the internal surface of the impeller 4 that slides on the intermediate region 10 of the portion 3*a* of the stem 3, while the second set of nozzles 15 is fed intermittently through the holes 12 and causes, by virtue of the opening and closure of the mouth of the nozzles, a series of hydraulic shocks which cause the advancement of the head in the duct.

It is noted that the constant rotation of the impeller 4, in addition to the hydraulic shocks, causes a sort of continuous vibration of the head which facilitates its advancement with respect to what would occur if the head started from a motionless condition.

The elongated stem 3 is provided, at both ends, with fixing means 19 for deformable elements (in order to be able to work even if the cross-section of the duct decreases, for example due to deposits) for centering the stem in the duct; such elements may be of various kinds.

Figure 9A:
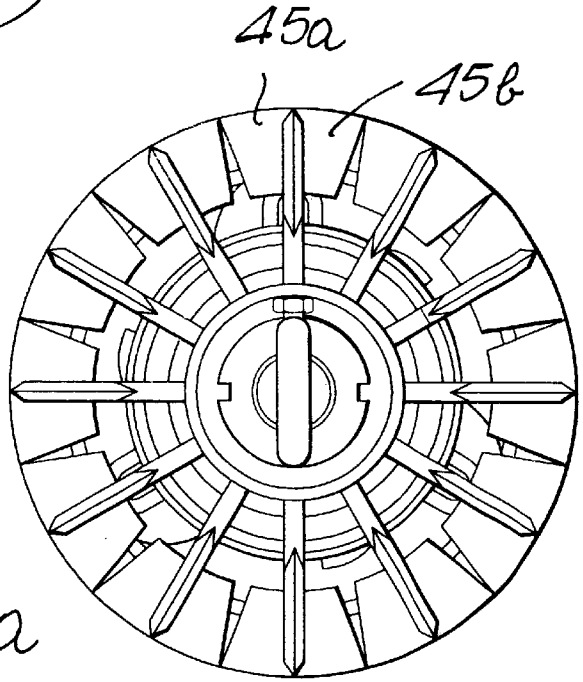
FIGS. 9 and 9*a* are respectively a side view and a front view of a single-stage apparatus according to the invention with elements for cleaning and centering in the duct which are provided with brushes and with a scraping and removal head and are arranged at the front.
Figure 9:
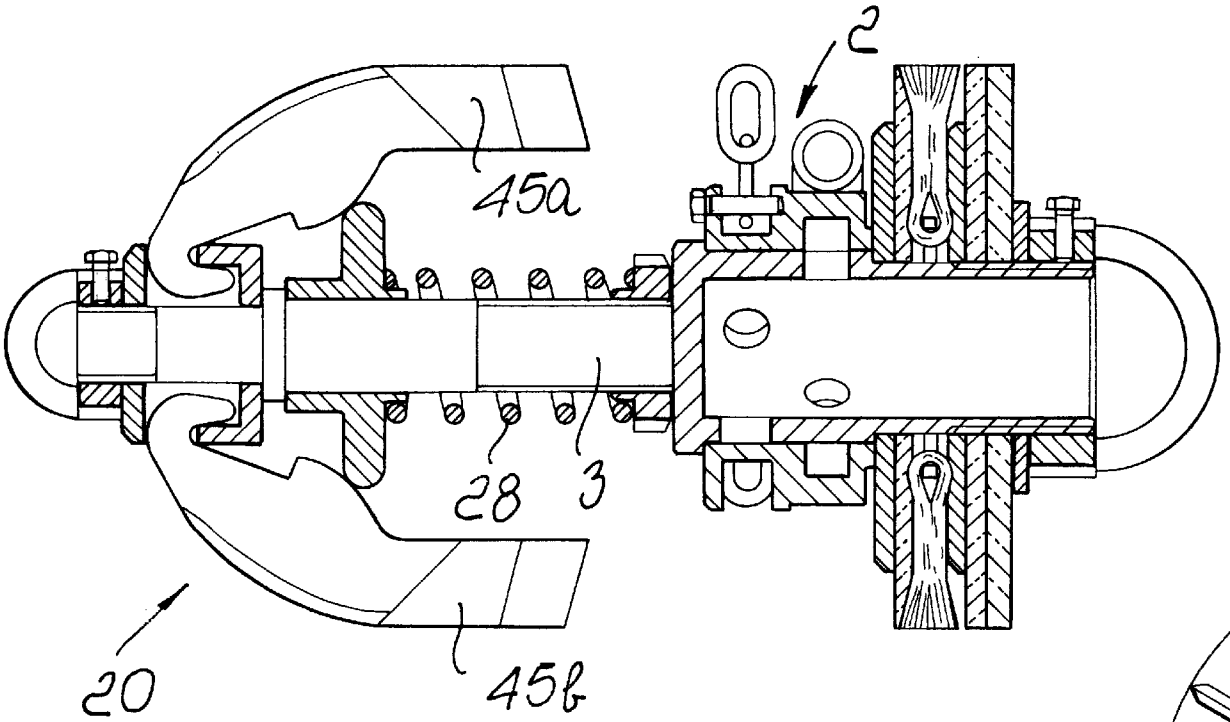
Figure 10:
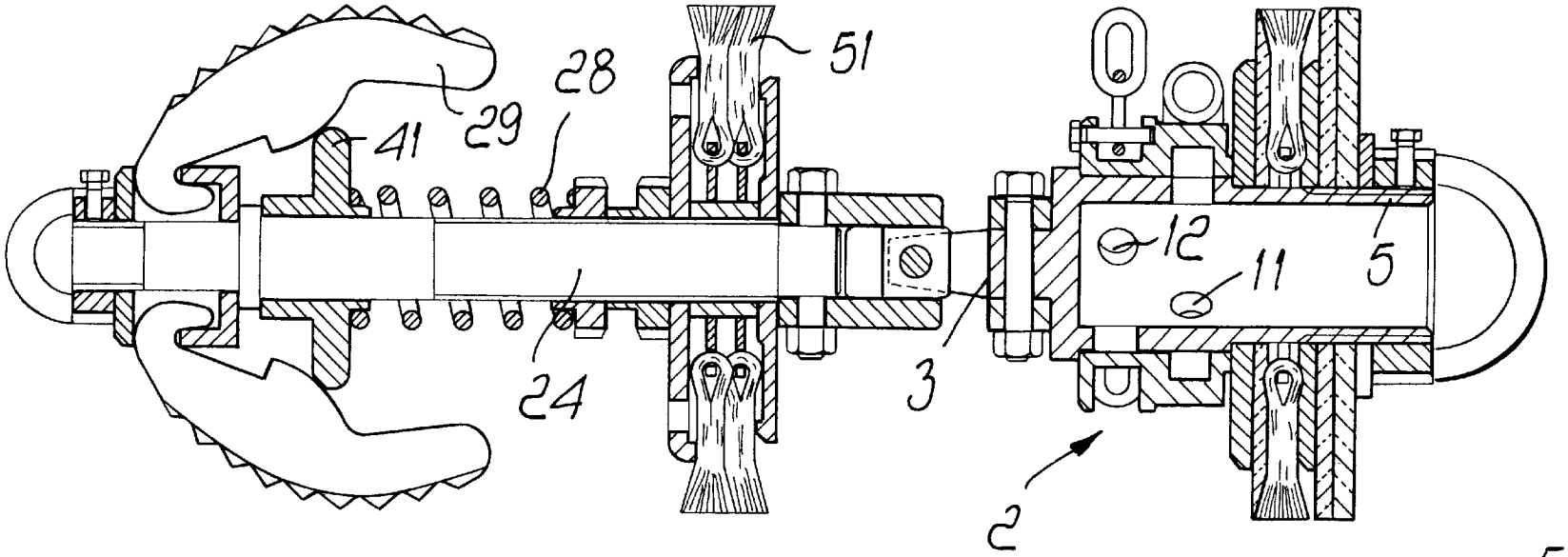
FIGS. 10 and 10*a* are respectively a side view and a front view of an apparatus according to the invention with two stages, namely a propulsion stage and a front stage with elements for cleaning and centering in the duct which are provided with brushes and with a breaker head.
Figure 10A:
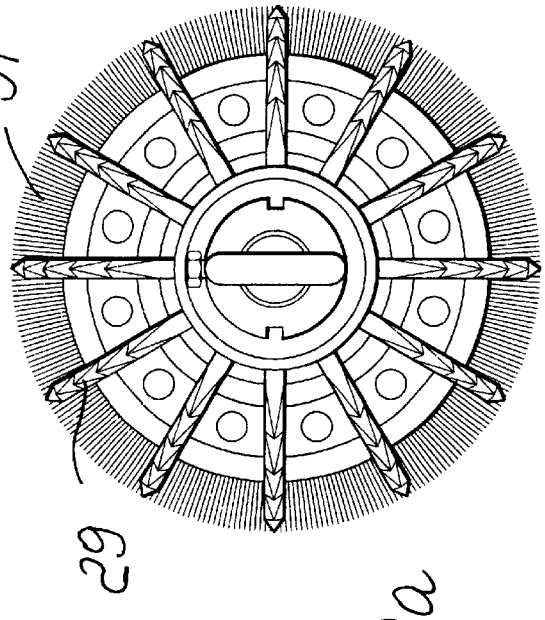
Figure 11:
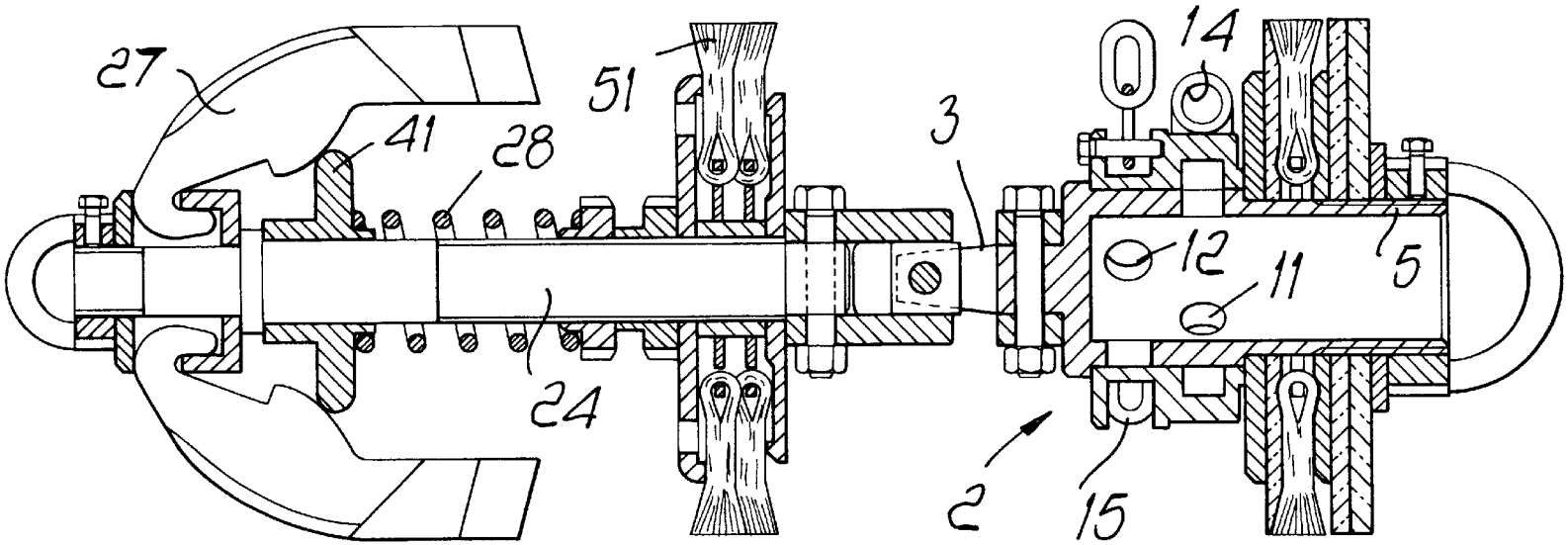
FIGS. 11 and 11*a* are respectively a side view and a front view of an apparatus according to the invention with two stages, namely a propulsion stage and a front stage with elements for cleaning and centering in the duct which are provided with brushes and with a removal head.
Figure 11A:
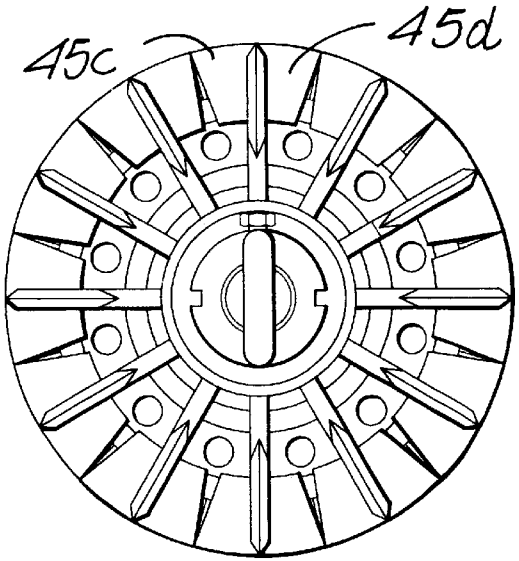
Figure 12:
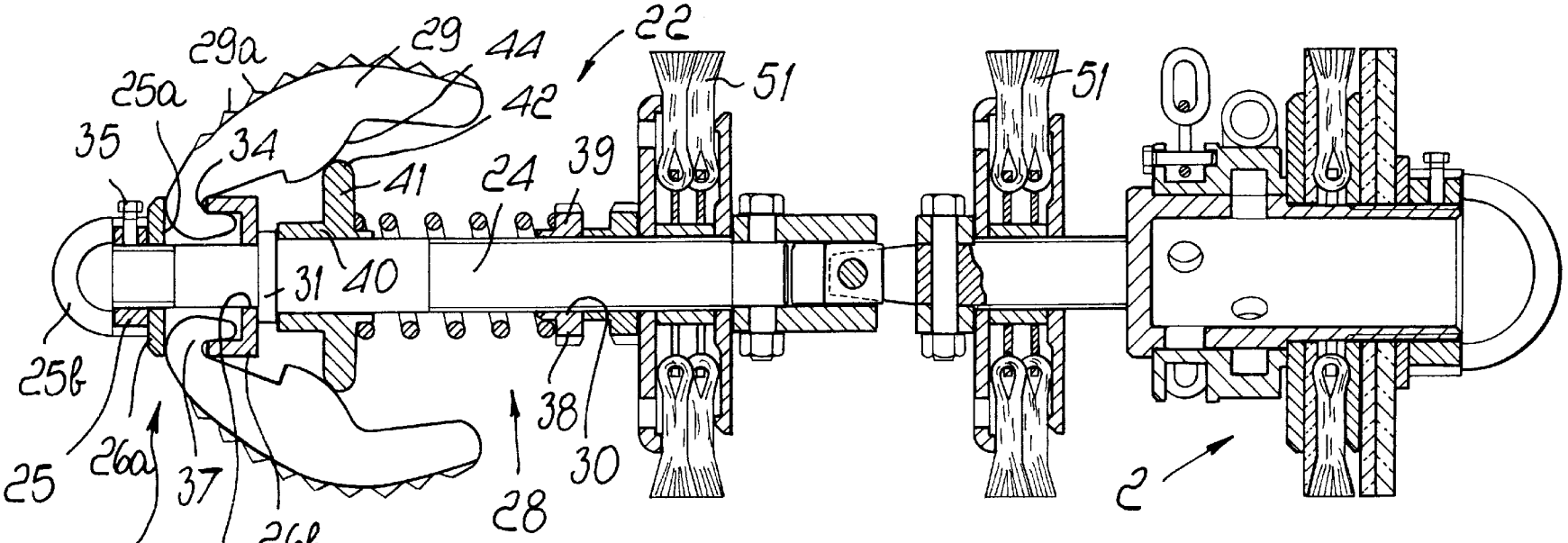
FIGS. 12 and 12*a* are respectively a side view and a front view of an apparatus according to the invention with two stages, namely a propulsion and cleaning stage and a front stage with elements for cleaning and centering in the duct which are provided with brushes and with a breaker head.
Figure 12A:
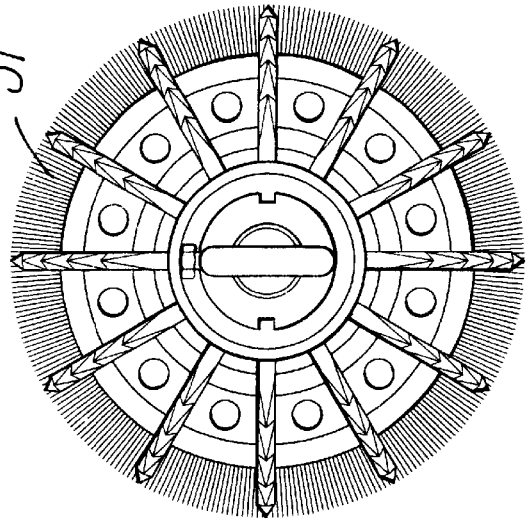
Figure 13:
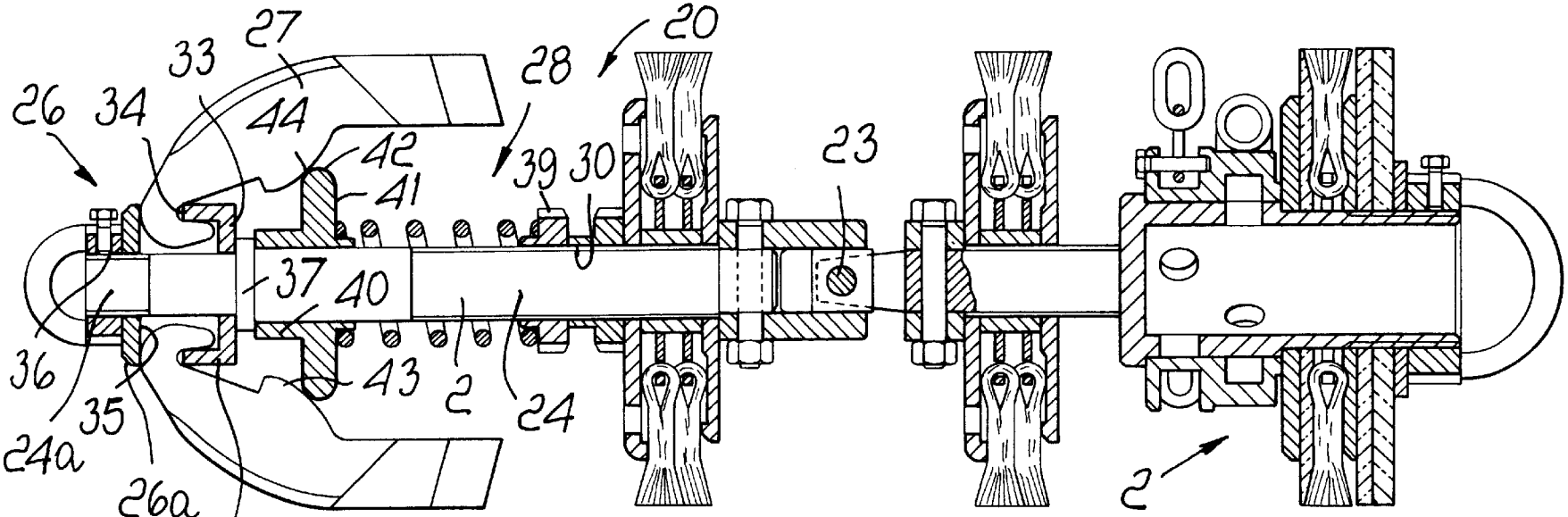
FIGS. 13 and 13*a* are respectively a side view and a front view of an apparatus according to the invention with two stages, namely a propulsion and cleaning stage and a front stage with elements for cleaning and centering in the duct which are provided with brushes and with a removal head.
Figure 13A:
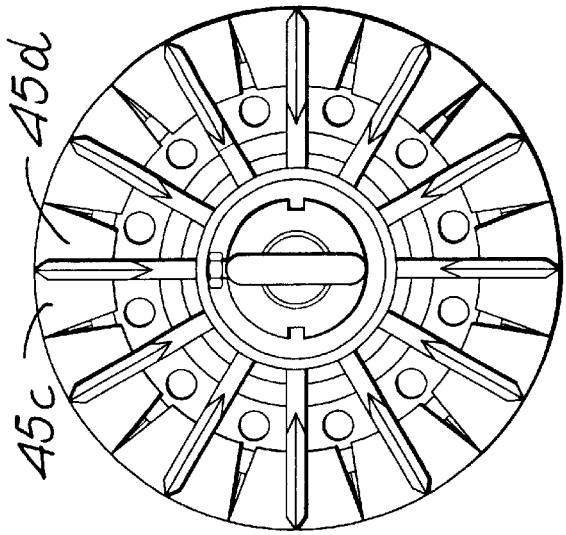

The deformable centering and removal elements can be constituted by removal heads 20 (FIG. 9), scraper heads 21 (FIG. 13), breaker heads 22 (FIG. 12), circular brushes 51 with radial metallic bristles, or other devices.

The removal elements comprise a central stem 24 to the rear of which there is a hole 23 for a diametrical pin for universal-joint coupling and to the front of which there is a threaded region and a diametrical hole for fixing a universal joint or a nut 25 with a diametrical bolt 25*a* which is provided with an engagement eye 25*a* at the front.

A block 26 is rigidly packed on the front end of the stem 24 and supports, so that they are hinged and can oscillate on radial planes, the front ends of a plurality of arc-like scraper claws 27 or breaker claws 29 which are pushed by elastic means 28 into contact against the walls of the duct C.

The stem 24 has, in its rear portion, a threaded region 30 and has, at a short distance from the front end, a prism-shaped larger region 31 which is shaped, for example, like a hexagonal nut.

The block 26 is constituted by two portions 26*a* and 26*b* which are packed together; the portion 26*b* is cup-shaped, has a central hole 32 for the passage of the stem and a rear face 33 of the base against which the larger portion 31 of the stem rests; radial notches 34 are formed in the portion 26*b* starting from the inlet, and the inlet of the portion 26*b* rests against the rear wall 35 of the portion 26*a*, which has an axial threaded hole 36 into which the threaded front end 24*a* of the stem 24 screws.

Advantageously, for small heads the radial notches provided in a portion 26*b* are for example eight or less, whereas in the examples illustrated in the figures they are twelve.

After fitting the portion 26*b* on the stem, the front ends 37 of the claws 27 or 29 are inserted in the notches 34 and are folded back so as to constitute a loose interlock coupling: after fitting the portion 26*a* and screwing the nut 25 with the corresponding diametrical bolt, an oscillating mounting of the claws is achieved.

The elastic means 28 are constituted by a powerful helical compression spring which is fitted coaxially on the stem between an abutment washer 38, which can be clamped by screwing and has a nut-shaped profile 39 for engagement by a wrench, and a respective bush 40 which can slide along the stem and is rigidly provided with a slightly flared flange 41 with a rounded edge 42 which is meant to act on respective cam profiles 43 and 44 of the claws.

The screwing and unscrewing of the nut 39 allows to adjust the force applied by the spring according to the type of work to be performed on the deposits.

Advantageously, in order to improve its effectiveness, the external profile of the claws 29 of the breaker heads can have teeth 29*a* and can have plates of wear-resistant material, for example of the type commercially known as widia, distributed thereon.

Figure 14:
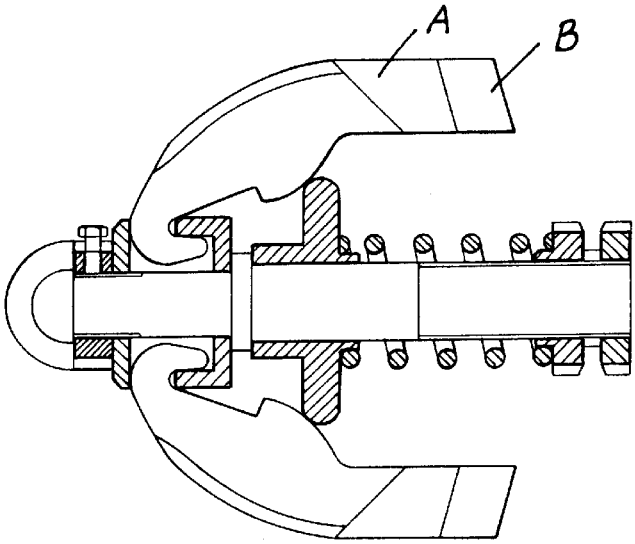
FIGS. 14 and 14*a* are respectively a side view and a front view of an improved removal head.
Figure 14A:
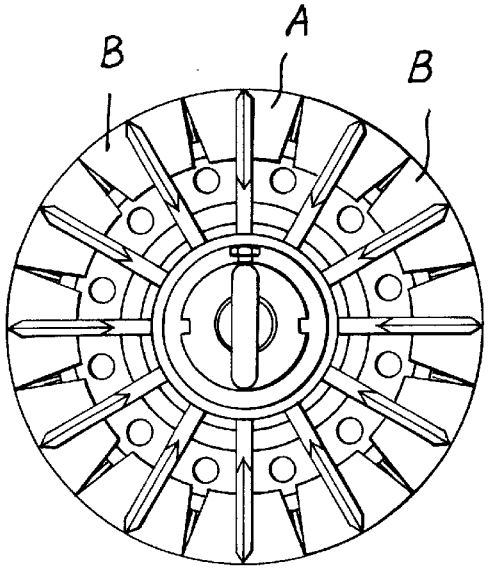
Figure 14C:
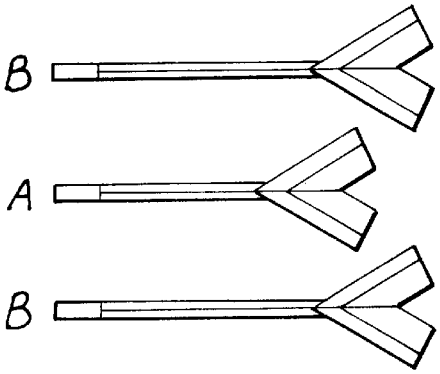
FIGS. 14*b* and 14*c* are respectively a side view and a front view of two details of said removal head.
Figure 14B:
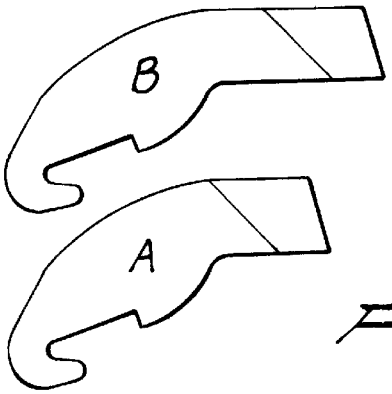
Figure 15:
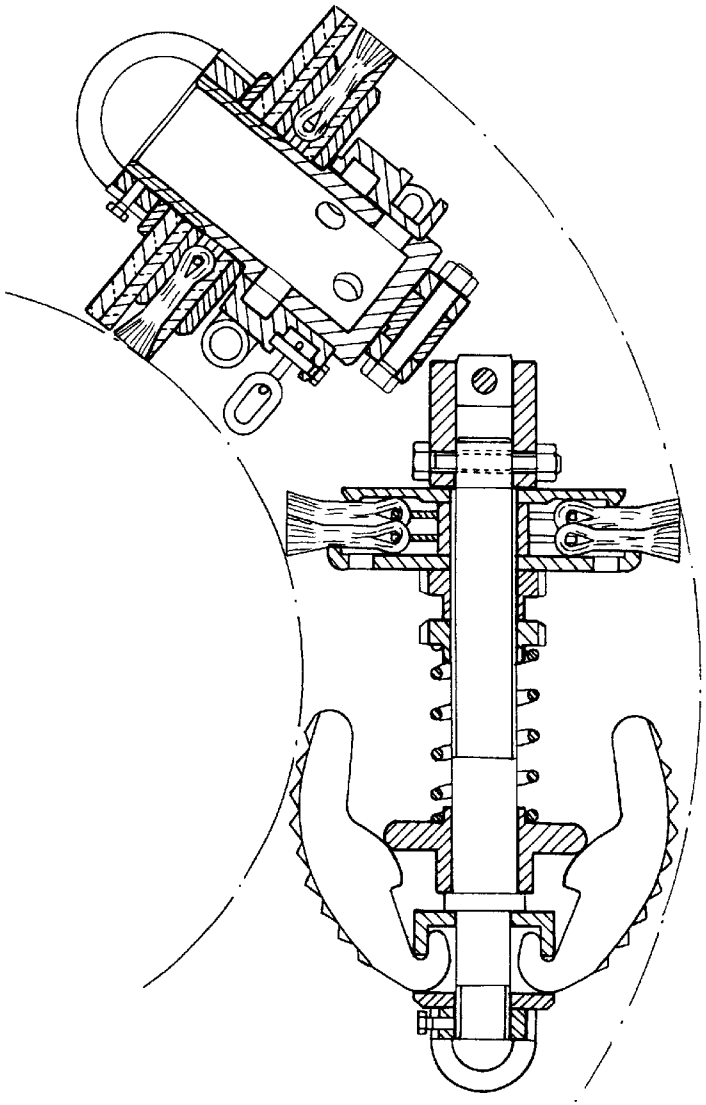
FIG. 15 is a sectional side view of how the single-stage and two-stage apparatus according to the invention arranges itself on a curved duct which has a tight radius of curvature.
Figure 15:
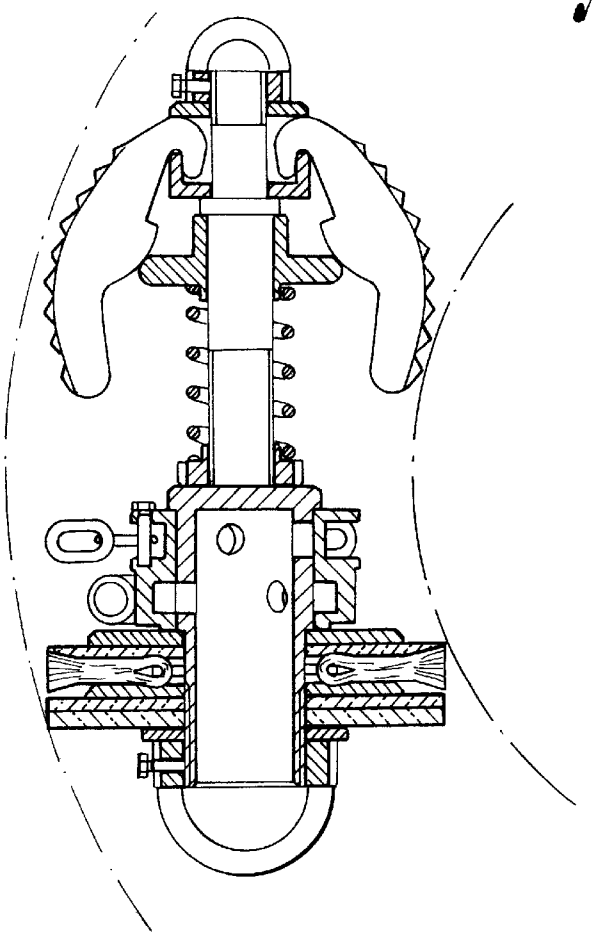

The free ends of the claws 27 in the removal heads 20 are fork-shaped, with flattened prongs 45*a* and 45*b* which are orientated radially with respect to the stem in order to facilitate separation of the pasty or solid components from the pipes, performing an action similar to that of moldboards in plows. Since in order to allow free oscillations of the claws space remains between the ends of the prongs of contiguous forks (and therefore bands of unremoved material would remain inside the ducts after the passage of the scraper heads), the claws can alternately have a shorter length A or a greater length B, so that the ends of the prongs 45*a*, 45*b* can have slightly overlapping paths, in order to affect all of the internal surface of the pipe (see FIG. 14).

T-shaped end elements having a curved external profile 45*c*, 45*d* are rigidly coupled in the scraper heads 21 at the free ends of the claws 27 and act as a sort of chisels in respective sectors of the duct.

For particular treatments it has been found that it is advantageous to assemble a head for removal and simultaneous breaking which is constituted by two claws of the fork-like type 27 alternated with two toothed claws 29: the connection of two or more heads of this type with mutually staggered claws allows, in a single pass, a toothed claw to form a sort of deep groove which is widened by the subsequent fork-like claw, which also removes and detaches the deposits from the walls.

In order to facilitate penetration in the deposits and their separation, the prongs of the breaker heads form angles of preferably 50/60° in plan view with respect to the imaginary extension of the outer surface that converges toward the center of the duct to be treated.

The larger-diameter rear portion 3*a* of the stem 3 is externally provided with a threaded portion 46, a smooth portion 47 and an annular flange 48: a disk 49 rests against the flange 48, is crossed centrally by a hole for centering on the stem, is made of metallic material, has a front chamfer 49*a* and is smaller in diameter than the duct to be cleaned. A plate 50 is packed against the disk 49, is made of deformable material, such as reinforced rubber, special polyurethanes, plastics, leather or the like, and has a rounded perimetric lip 50*a* and a diameter which is substantially equal to the diameter of the duct C, a brush with steel bristles 51 supported radially by a central ring 52, a rear metal disk 53 which is similar to the disk 49, two deformable plates 54 and 55 which are similar to the plate 50, and a rear washer 56 which has a reduced diameter: a nut 57 with a diametrical locking bolt 58 is screwed against the washer 56 and is provided, in a rear region, with an engagement eye 59.

Advantageously, at the second set of nozzles 15, on the outside of the bush 13, there are pairs of chain links 61, 62 which are fitted by means of three bolts 60; by virtue of the rotation of the bush at high speeds, the links are pushed outward by centrifugal force and strike and break up any residues of deposits of the internal surface of the pipe.

To the rear of the stem 24 it is possible to fit cleaning and centering brushes 51, similar to those described earlier for the propulsion head, or to add the rear part of a propulsion head with a scraper or breaker head: it is possible to install, so that they are articulated in front of one another, two heads of this type, each provided with one half of the propulsion head without requiring coupling to another propulsion head.

It is noted that if necessary (for example if the apparatus is blocked by narrower portions, foreign objects or the like), it is possible to intervene from the front or from the rear on the nuts 25 or 57 in order to unscrew them and disassemble the heads into their individual components, so as to be able to easily remove them, thus separated, from the pipe.

In order to keep the heads constantly aligned inside the duct to be treated, it has been found that correct size selection of certain components is essential. In practice, the length of the central stems 3 or 24 plus the length of a universal joint should be substantially equal to twice the diameter of the duct; the distance in each head between the respective points of contact with said duct should also be modular and substantially equal to the diameter of the duct. In practice, the distance between the centerlines of the brushes, between the disks with rotating elements, or also between the initial part of the straight portions of the claws and the corresponding brushes, should be equal to the diameter of the duct. The distance between the points of contact of two successive heads coupled to each other by means of a universal joint should also be equal to the diameter of the duct. Moreover, it is essential that the distances between each universal joint and the respective points of contact with the duct of the leading head and of the trailing head be equal.

If the above prescriptions are met, it is possible to work on ducts which have elbows whose radius of curvature is equal to 1.5 diameters.

It is noted in any case that even if the apparatus stops inside the duct, the liquid can continue to flow without any problem and the loss in flow-rate is approximately 50%.

According to the type of work to be performed, removal of sediments such as paraffins, sludges, grit, scale, rust or others, a plurality of heads having various characteristics are fixed to each other and are connected to each other by means of universal joints; it is thus possible to join, on a single stem, a propulsion head and a cleaning head, or a scraper head or a breaker head, and to compose a train of variously combined heads in order to provide a modular system.

Advantageously, components which keep the head substantially centered on the axis, regardless of the path of the duct, are fitted on the central stem.

It has thus been observed that the invention achieves the intended aim and object.

The invention thus conceived is susceptible of numerous modifications and variations, all of which are within the scope of the inventive concept.

All the details may furthermore be replaced with other technically equivalent ones.

The materials used, as well as the shapes and the dimensions, may of course be any according to requirements without thereby abandoning the scope of the protection of the appended claims.

What is claimed is:

1. An apparatus for cleaning and removing deposits from the internal walls of ducts for conveying fluids of any kind, comprising:

at least a propulsion head which comprises an elongated stem and an impeller which is mounted freely on the stem for producing an uninterrupted vibration and a series of hydraulic shocks or hammerings in order to cause the advancement of the head in a duct; and at least one of a cleaning element and a removal element which is provided with means for rigid fixing to one of: a front end of the stem; and means for engagement to one of the front end of said stem and a rear end of said stem;

said elongated stem having a rear region and a cavity at said rear region, said cavity being open rearwardly for intake of pressurized fluid and wherein said stem has, in a front region thereof, a first and a second set of radial holes for the discharge of the fluid;

said impeller being mounted so that it can rotate freely on the stem at said holes and is provided with two sets of fluid discharge nozzles having end portions which have an identical tangential orientation and are suitable to turn the impeller by reaction to the discharge of the fluid, the first set of nozzles being fed continuously by means of an annular channel formed on an inner surface of the impeller, the second set of nozzles being fed intermittently for causing, by virtue of opening and closure of said nozzles, said series of hydraulic shocks adapted to produce the advancement of the head in the duct.

2. The apparatus according to claim 1, further comprising deformable elements for centering in the duct, said elongated stem being provided, at both ends thereof, with means for fixing said deformable elements for centering in the duct.

3. The apparatus according to claim 1, wherein said cleaning elements comprise at least one cleaning disk comprising one of: brushes with steel bristles which are substantially radial; and removal laminae which have elastically deformable components for acting as means for centering the head in the duct.

4. An apparatus for cleaning and removing deposits from the internal walls of ducts for conveying fluids of any kind, comprising:

at least a propulsion head which comprises an elongated stem and an impeller which is mounted freely on the stem for producing an uninterrupted vibration and a series of hydraulic shocks or hammerings in order to cause the advancement of the head in a duct; and at least one of a cleaning element and a removal element which is provided with means for rigid fixing to one of: a front end of the stem; and means for engagement to one of the front end of said stem and a rear end of said stem;

said removal element comprising a scraper head with a plurality of arc-like movable claws comprising a central stem which has, at one of a front and a rear of said central stem, an articulation for coupling to said front end of the stem of the propulsion head and has, in said front thereof, a rigidly coupled block which supports front ends of said plurality of arc-like claws so that said claws are hinged and can oscillate on radial planes, said claws being pushed by adjustable elastic means into contact with walls of the duct and having, at ends thereof, end portions which are substantially arranged in a T-shaped configuration;

said claws having cam profiles;

an abutment being rigidly coupled to the rear of said central stem;

said elastic means comprising a helical compression spring which is fitted between said abutment which is rigidly coupled to the rear of said central stem and a bush which can slide along the central stem and has a flange for acting on respective said cam profiles of the claws.

5. An apparatus for cleaning and removing deposits from the internal walls of ducts for conveying fluids of any kind, comprising:

at least a propulsion head which comprises an elongated stem and an impeller which is mounted freely on the stem for producing an uninterrupted vibration and a series of hydraulic shocks or hammerings in order to cause the advancement of the head in a duct; and at least one of a cleaning element and a removal element which is provided with means for rigid fixing to one of: a front end of the stem; and means for engagement to one of the front end of said stem and a rear end of said stem;

said removal element comprising a scraper head with a plurality of arc-like movable claws comprising a central stem which has, at one of a front and a rear of said central stem, an articulation for coupling to said front end of the stem of the propulsion head and has, in said front thereof, a rigidly coupled block which supports front ends of said plurality of arc-like claws so that said claws are hinged and can oscillate on radial planes, said claws being pushed by adjustable elastic means into contact with walls of the duct and having, at ends thereof, end portions which are substantially arranged in a T-shaped configuration;

radial notches for articulated coupling of said claws;

said block comprising two portions which are packed together and between which said radial notches for articulated coupling of the front ends of said claws are formed.

* * * * *